US005822956A

United States Patent [19]

Liechti et al.

[11] Patent Number: 5,822,956

[45] Date of Patent: Oct. 20, 1998

[54] VACUUM PACKAGING MACHINE

[75] Inventors: Vreny Liechti, Goldach; Bruno Landolt, Herisau, both of Switzerland

[73] Assignee: Inauen Maschinen AG, Herisau, Switzerland

[21] Appl. No.: 571,988

[22] PCT Filed: May 2, 1995

[86] PCT No.: PCT/CH95/00094

§ 371 Date: Jul. 3, 1996

§ 102(e) Date: Jul. 3, 1996

[87] PCT Pub. No.: WO95/29846

PCT Pub. Date: Nov. 9, 1995

[30] Foreign Application Priority Data

May 3, 1994 [CH] Switzerland ..... 1374/94

[51] Int. Cl.[6] ..... B65B 31/00

[52] U.S. Cl. ..... 53/510

[58] Field of Search ..... 53/510, 511, 512, 53/432, 435, 434

[56] References Cited

U.S. PATENT DOCUMENTS

| | | | |
|---|---|---|---|
| 4,344,270 | 8/1982 | Andersson | 53/511 |
| 4,480,425 | 11/1984 | Furukawa | 53/511 |
| 4,578,928 | 4/1986 | Andre et al. | 53/512 |
| 4,920,726 | 5/1990 | Yamada et al. | 53/512 |
| 5,027,578 | 7/1991 | Natterer et al. | 53/512 |
| 5,381,644 | 1/1995 | Di Bernardo | 53/511 |
| 5,465,557 | 11/1995 | Harte | 53/510 |

FOREIGN PATENT DOCUMENTS 1597655 6/1970 France .

*Primary Examiner*—Joseph J. Hail, III
*Assistant Examiner*—Ed Tolan
*Attorney, Agent, or Firm*—Jacobson, Price, Holman & Stern, PLLC

[57] ABSTRACT

The invention concerns a vacuum packaging machine having a sub-structure (1) and a cover (2). The machine further comprises a vacuum chamber (3) which is disposed in the vicinity of the union between the cover (2) and the sub-structure (1) and which comprises an upper part (4) and a lower part (5). The machine cover (2) comprises a base member (10) and at least one arm (11, 12), the arm being connected to the base member at one end. The chamber upper part (4) is mounted on the cover member (10) and the chamber lower part (5) is disposed in the sub-structure (1). The machine sub-structure (1) is provided with at least one guide roller (21) for the cover arm (11, 12), this guide roller engaging in the cover arm. The cover arm end remote from the cover base member (10) is connected to a drive device (20) by means of which the cover (2) can be moved. A device (55) for delivering a foil (51) into the interior of the vacuum chamber (3) is provided.

18 Claims, 4 Drawing Sheets

VACUUM PACKAGING MACHINE

The present invention relates to a vacuum packaging machine having a substructure and having a cover, it being possible for the cover to be moved with respect to the substructure.

A previously known vacuum packaging machine of this generic type has a vacuum chamber for treating items to be packaged, the vacuum chamber being arranged in the region of the transition from the cover to the substructure. Said chamber comprises an upper part and a lower part, the upper part being assigned to the machine cover and the chamber lower part being assigned to the machine substructure. In said previously known machine, the cover is connected pivotably to the machine substructure with the aid of hinges. The outline of the vacuum chamber is intended to be as large as possible in order that as many items as possible can be treated simultaneously in said chamber. On the contrary, for a number of reasons, the aim is to keep the outline of the substructure of the machine as small as possible. This results in the hinges on the substructure being located close to the rear wall of the vacuum chamber. The end side of the cover is usually provided with at least one handle. The operator uses said handle to open and close the machine, and thus also the vacuum chamber.

In the case of said vacuum packaging machine, the cover of the same, when in its open position, is at an angle with respect to the upper side of the substructure, this angle being smaller than 90 degrees. It is thus difficult to gain access to the interior of the chamber lower part, in particular in the region of the rear wall of said vacuum chamber, which renders loading and unloading of the vacuum chamber more difficult.

In a fair number of machines of this generic type, a heating plate is located in the upper part of the vacuum chamber. It takes some time for said heating plate to cool down once the items in the chamber have been treated and, when the vacuum chamber is opened and the cover is then positioned obliquely and at a comparatively low level, there is a high risk of the operator burning himself on the heating plate during unloading of the vacuum chamber.

The object of the present invention is to specify a vacuum packaging machine which does not have, among others, the abovementioned disadvantages.

In the case of the vacuum packaging machine of the generic type mentioned in the introduction, this object is achieved as is defined in the characterizing part of claim 1.

Figure 1:
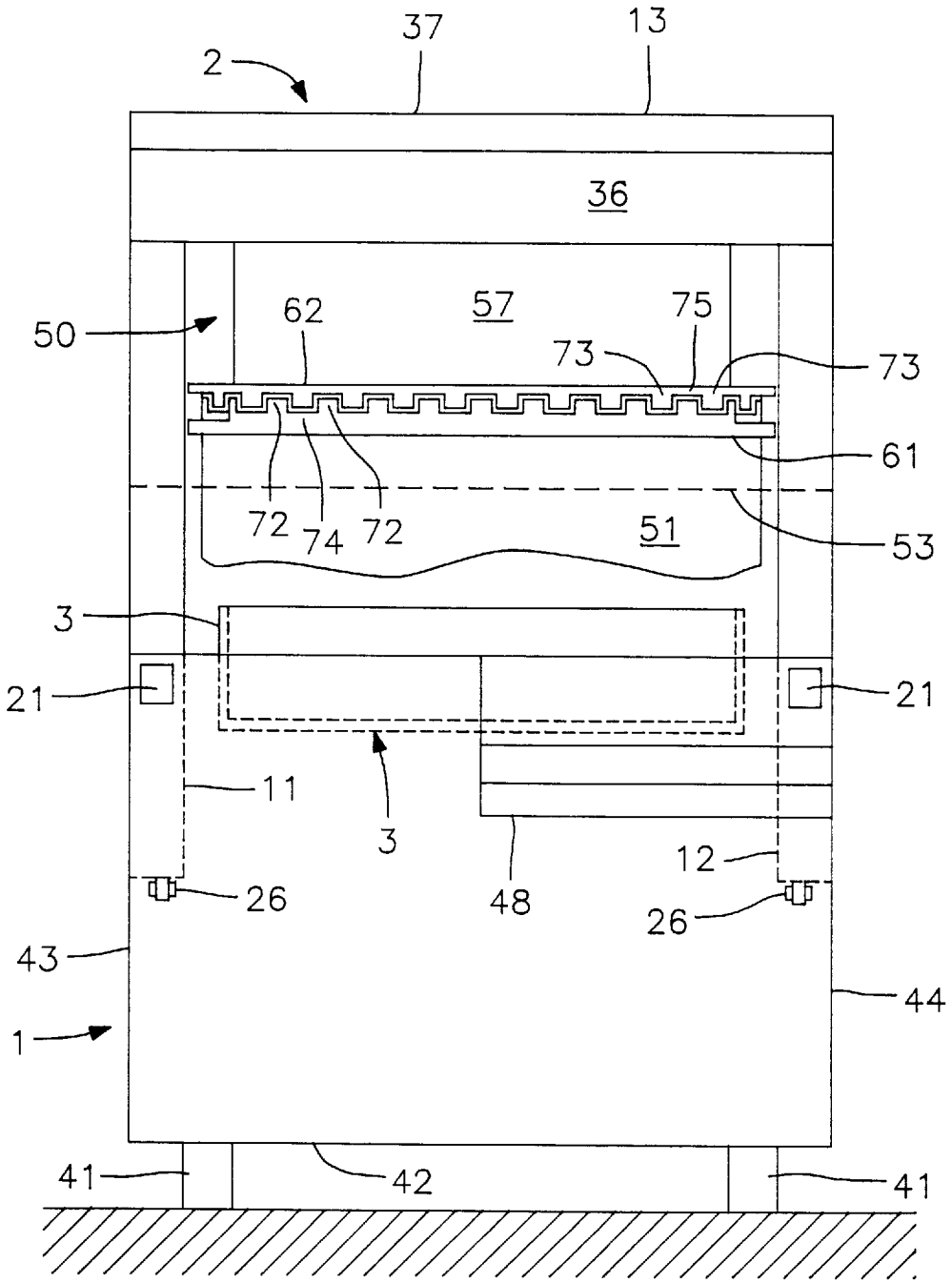
Figure 2:
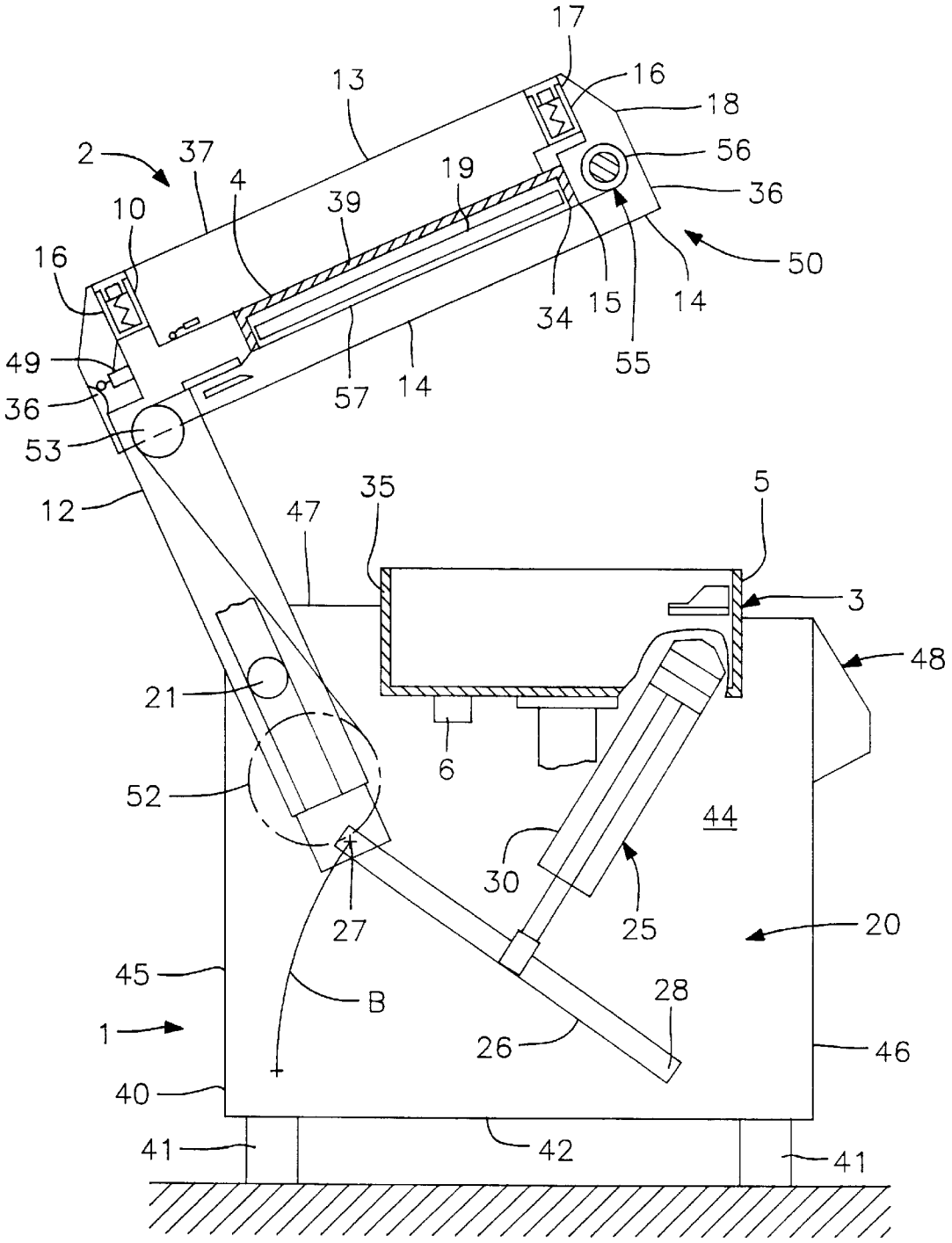
Figure 3:
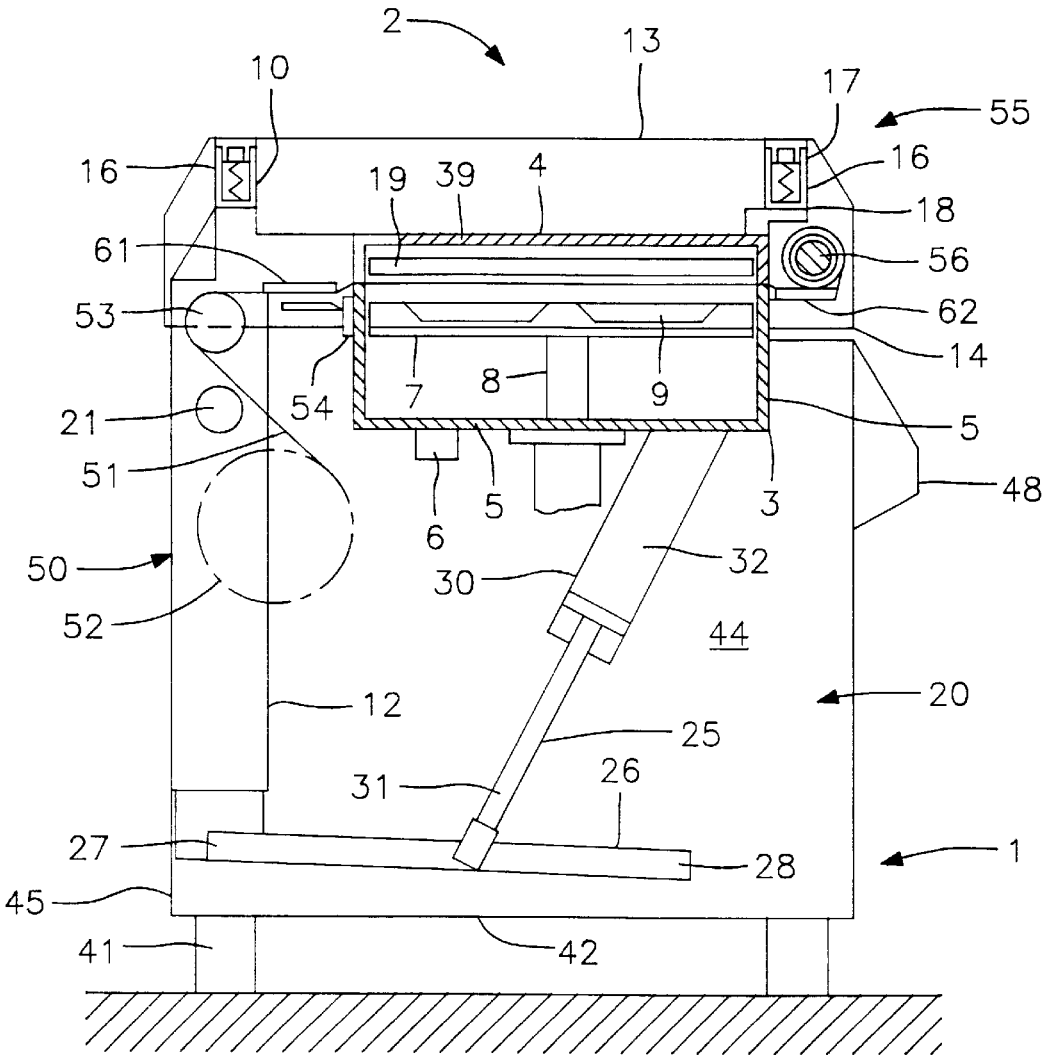
Figure 4:
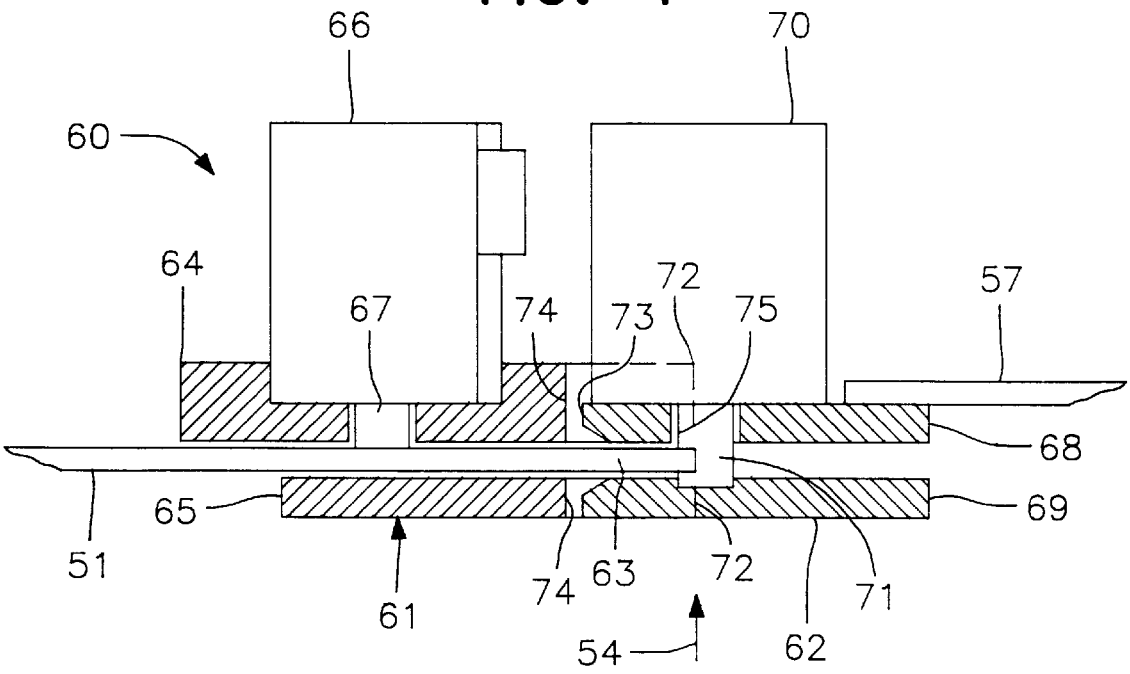
Figure 5:
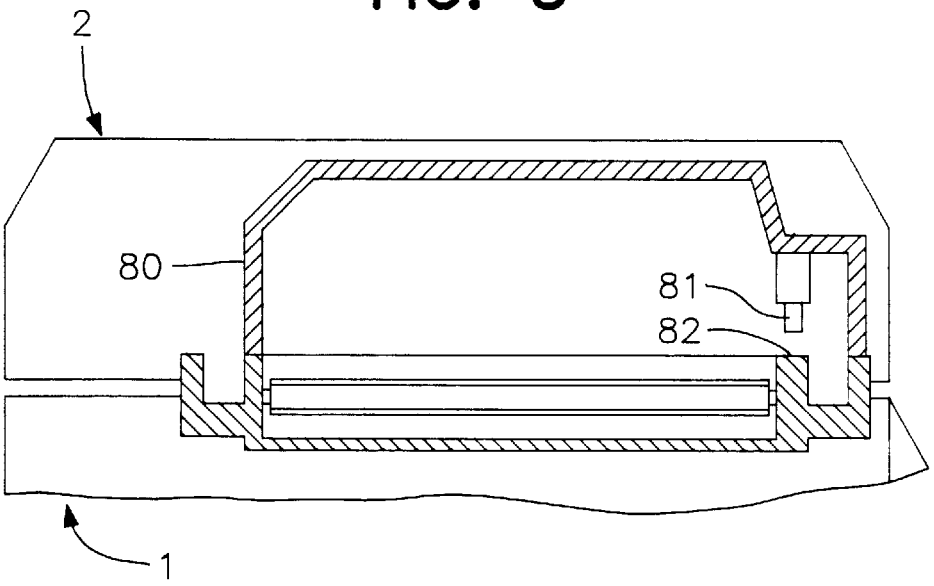

Possible embodiments of the present invention are explained in more detail hereinbelow with reference to the accompanying drawings, in which:

FIG. 1 shows a front view of a first configuration of the present vacuum packaging machine, the latter being open, FIG. 2 shows the machine from FIG. 1 in a vertical section, said section running perpendicularly with respect to the front wall of the machine, FIG. 3 shows the machine from FIG. 1 in the abovementioned vertical section, said machine being closed, FIG. 4 shows, in a vertical section, a detail of the machine according to FIG. 1, and FIG. 5 shows, in a vertical section, part of another configuration of the vacuum packaging machine.

FIG. 1 shows a front view of a first configuration of the present vacuum packaging machine, the latter being open. FIG. 2 shows the machine from FIG. 1 in a vertical section, said section being perpendicular with respect to the front wall of the machine. In FIG. 3, said machine is represented in a vertical section, the machine being closed.

The vacuum packaging machine comprises a substructure 1 and a cover 2 which can be moved with respect to the substructure 1. The substructure 1 has a body 40 which is provided with feet 41. Said feet 41 are fitted on the underside of the base 42 of said body 40. The body 40 further has side walls 43, 44, 45 and 46 and a top or upper side 47. The front side wall 46 is provided with a box 48 which carries or contains the means for operating the machine.

The cover 2 is fitted on the substructure 1 such that the movement or the path of movement of the cover 2 with respect to the substructure 1 has two components. Said components of movement follow one after the other and, moreover, partially overlap. The first component of movement of the cover 2 constitutes a translatory movement. The second component of movement of the machine cover 2 constitutes a pivot movement. The start of the first component of movement or the start of the corresponding path of movement of the cover 2 follows on from the upper side 47 of the substructure body 40, where the movement of the cover is a virtually pure rectilinear movement. The end part of the second component of movement is a virtually pure pivot movement, and this end part is at that end of the path of movement of the cover 2 which is remote from the body 40.

The vacuum packaging machine also comprises a vacuum chamber 3 which is arranged in the region where the cover 2 and the substructure 1 meet. The vacuum chamber 3 is made up of an upper part 4 and a lower part 5, said chamber parts 4 and 5 being open on one side. The openings of these chamber parts 4 and 5 are brought to bear one upon the other when the machine is closed. The chamber upper part 4 is arranged in the region of the underside or of the opening of the cover 2 and contains a heating plate 19. Said heating plate 19 runs virtually parallel to the base 39 of the chamber upper part 4. The chamber lower part 5 is arranged such that it can be sunk in the upper side 47 of the substructure 1. Edges which bound the opening of the respective chamber part 4 or 5 and are located on the side walls 34 and 35 of said chamber parts 4 and 5 are arranged and designed such that they can bear one upon the other in an air-tight manner when the machine, and thus also the chamber 3, is closed.

The vacuum chamber 3 is provided with a connection stub 6 to which a vacuum device (not shown) of a type which is known per se is connected in a manner which is known per se. Located in the lower part 5 of the vacuum chamber 3 is a table 7 (FIG. 3) which is fastened on a lifting cylinder 8. Said lifting cylinder 8 passes through the base 38 of the chamber lower part 5 and, with the aid of said lifting cylinder or table cylinder 8, the table 7 can be moved back and forth in the vertical direction. Flat depressions 9 are made in the upper side of the table panel 7, into which depressions it is possible to introduce dishes (not shown) with the items which are to be packaged.

The machine cover 2 has a virtually panel-like basic body 10 and arms 11 and 12. The basic body 10 is essentially square. The arms 11 and 12 are fixed at one end on one of the sides of the panel-like basic body 10. The end parts of the respective arm 11 or 12 are located in one of the corner regions of said side of the basic body 10. The cover basic body 10 projects virtually at right angles from the cover arms 11 and 12. The outer side of the base 39 of the chamber upper part 4 is fastened on the underside of the cover basic body 10.

The machine cover 2 also has a hood 13, which covers over the basic body 10 as well as those constituent parts of the cover 2 which are fitted on said basic body 10. The hood 13 has a base 37 and side walls 36 which project down from the hood base 37. The lower edges 14 of the hood side walls 36 are located at a lower level than the lower edges 15 of the side walls 34 of the chamber upper part 4. The hood 13 is mounted in a movable manner on the cover basic body 10, to be precise such that it can move perpendicularly with respect to the plane of the basic body 10. The upper side of the cover basic body 10 is provided with means 16 which bear the hood 13 in a spring-mounted manner. Said means 16 are located at least in each corner of the basic body 10, and thus also of the hood 13.

The means 16, depicted in the drawings, for supporting the hood 13 comprise bushings 17, of which the base is fastened on the upper side of the cover basic body 10. Arranged in the respective bushing 17 is a spring 18 on which that section of the hood base 37 located above it rests. Arranged in the region of the side walls 36 of the hood 13 are switches 49 which are connected in the control circuits of the packaging machine such that further downwardly directed movement of the cover 2 is stopped if the lower edge 14 of at least one of the hood side walls 36 comes up against an obstruction. Consequently, it is possible for the hood 13 to serve not only as a means for protecting the cover parts, but also as an operational protection means or hand guard. This is because the hood 13 can prevent the situation where the hand of the operator becomes jammed between the mutually opposite edges of the side walls 34 and 35 of the chamber parts 4 and 5.

The machine substructure 1 is equipped with a device 20 for guiding the machine cover 2 with respect to the machine substructure 1. This guidance device 20 comprises rollers 21, of which in each case one is fitted in a rotatable manner on one of the mutually opposite side walls 43 or 44 of the body 40 of the machine substructure 1. Said rollers 21 are arranged in the vicinity of the rear wall 45 of the substructure 1 and, in the case represented, said rollers 21 project from the inside of the side walls 43 and 44. The respective cover arm 11 or 12 has a U-shaped or C-shaped cross-section. One of the guide rollers 21 is located in the interior of the respective cover arm 11 or 12, with the result that the respective cover arm 11 or 12 is in engagement with one of the rollers 21. This engagement is such that the cover arm 11 or 12 can be pivoted about the guide roller 21 and, at the same time, can also be displaced in its longitudinal direction.

That end of the cover arm 11 or 12 which is remote from the cover basic body 10 is connected to a drive device 25. Said drive device 25 comprises, inter alia, single-arm pivot levers 26, of which in each case one is assigned to one of the cover levers 11 or 12. One end 28 of said pivot lever 26 is articulated on the substructure 1, to be precise in the region of the base 42 of the body 40. The other end 27 of the pivot lever 26 is articulated at the free end of the cover arm 11 or 12. The drive device 25 further comprises double-acting lifting cylinders 30. The free end of the lifting rod 31 of the respective cover cylinder 30 is articulated on the pivot lever 26, between the abovementioned end parts 27 and 28 of the same. The free end of the housing 32 of the lifting cylinder 30 is articulated on the substructure 1, to be precise in the region of the upper side 47 of the body 40. FIG. 2 shows said drive device 25 in a first of its end positions, and FIG. 3 shows said device 25 in the other of its end positions. It is also possible for the machine to have only a single cover cylinder 30. In such a case, provision is made for a rod (not shown) which connects the pivot levers 26 to one another. The lifting rod 31 of the cover cylinder 30 then acts on the connecting rod.

In that end position of the drive device 25 (FIG. 3) which is represented in FIG. 3, the lifting rod 31 of the lifting cylinder 30 is extended the full extent out of the housing 32, with the result that the lever 26 is located at the bottom and is virtually parallel to the base 42 of the subsubstructure 1. The pivotable end 27 of said lever 26 is located in the vicinity of the rear wall 45 of the structure 1, said end 27 of the lever 26 being located beneath the guide roller 21. The cover levers 11 and 12, in which the guide roller 21 is located, are virtually vertical in this end position of the drive. At the same time, the upper part 4 of the vacuum chamber 3 bears on the chamber lower part 5 in an air-tight manner.

If the lifting rod 31 is retracted into the cylinder housing 32, then the pivotable end 27 of the lever 26 is raised and moves along a path B which is in the form of a segment of a circle. The center of the corresponding circle is located at the articulated end 28 of the pivot lever 26. On account of the thus curved path of movement, the pivotable end 27 of the lever 26 moves away from the rear wall 33 [sic] of the substructure 1 to an increasing extent during the upwardly directed movement of said lever end 27.

Since the last-mentioned lever end 27 is articulated at the lower or free end of the cover arm 11 or 12, the cover arm 11 or 12 is first of all moved upwards and virtually only rectilinearly in its longitudinal direction. This is because the cover arm 11 or 12 is guided by the roller 21 engaging in said cover arm 11 or 12. As the pivot end 27 of the pivot lever 26 moves further away from the base wall 42, and thus also from the rear wall 45 of the substructure 1, the lower end of the cover lever 11 or 12 also moves away from the rear wall 45 to an increasing extent. In this arrangement, the cover lever 11 or 12 also begins to pivot or tilt about the roller 21. Towards the end of the circular movement of the pivot lever 26, the cover lever 11 or 12 is virtually exclusively, or at least predominantly, tilted or pivoted about the guide roller 21.

It goes without saying that the opposite end parts of the inherently rigid cover levers 11 and 12 are moved in a corresponding manner during the abovedescribed movements. Since the cover basic body 10 is fastened at the upper end of the cover levers 11 and 12, the entire cover 2 also moves along with the upper end parts of the cover levers 11 and 12. This movement includes the two abovementioned components. FIG. 2 shows the cover 2 in its upper, extended and oblique position. By virtue of the fact that, as the machine is opened, the cover 2 has also effected a translatory and upwardly directed movement, the cover 2 is located at a considerable distance from the upper side 47 of the substructure 1. Consequently, it is very easy to gain access to all the regions of the lower part 5 of the vacuum chamber 3.

In order to close the abovementioned containers with the items which are to be packaged, use is made of plastic film which is laid over the upper border of the respective container. Thereafter, the chamber 3 is evacuated and the table 7 is moved up, with the aid of the table cylinder 8, to such an extent that the film is clamped between the upper border of the respective container and the heating plate 19. Due to the heat radiated by the heating plate 19, the film is welded onto the upper border of the container and the items are thus packaged in the container in an air-tight manner.

In order that such a vacuum packaging machine can operate as quickly as possible, it has a device 50 for automatically feeding the respectively necessary section of the film 51. Said device 50 comprises a section 52 which serves to receive a supply of film. Said section 52 is located in the substructure 1 and it contains a roll with a film web, the end parts of said roll being mounted rotatably in the side walls 43 and 44 of the substructure 1 in a manner known per se (not shown). The width of the film web is less than the distance between the cover levers or cover arms 11 and 12.

Arranged in the region of the upper end parts of the cover levers 11 and 12 is a deflection roller 53 for the film web 51, said deflection roller 53 extending between the cover arms 11 and 12 and being mounted rotatably therein. Said deflection roller 53 is arranged with respect to the opening 15 of the upper part 4 of the vacuum chamber 3 such that that tangent to the deflection roller 53 which runs parallel to the opening 15 of the chamber upper part 4 is located at a short distance from said opening 15. Said distance may be between 2 to 20 mm. As can be seen from FIG. 3, the film web 51 passes through between the chamber parts 4 and 5 when the vacuum chamber 3 is closed. Fitted on the feed side of the vacuum chamber 3 is a device 54 which is known per se and intended for severing the respective film section from the rest of the supply of film.

The feed device 50 also comprises a means 55 for advancing the film web 51. Said advancement means 55 contains a drivable roller 56 which is mounted in the cover basic body 10 such that it can be rotated and driven. Said advancement roller 56 is located in the front region of the machine cover 2, i.e. in that region of the cover 2 which is located opposite the cover arms 11 and 12. The advancement roller 56 runs parallel to the front wall 34 of the chamber upper part 4. A tangent to the advancement roller 56 which is parallel to the opening 15 of the chamber upper part 4 is located at a short distance in front of the opening 15 of the chamber upper part 4, it being possible for said distance to be equal to the abovementioned and corresponding distance with the deflection roller 53. A web 57 of material is wound up at one end on the advancement roller 56, and said material web 57 is at least as wide as the heating plate 19 in the vacuum chamber 3. The web 57 is advantageously made of a comparatively thick woven fabric. The opposite end of the material web 57 is connected to a clamping device 60.

The clamping device 60 (FIG. 4) comprises two pairs 61 and 62 of strips. The first pair of strips 61 retains the start of the next film section, or the front border 63 of the film web 51, which is to be drawn over the table 7 in the lower part 5 of the vacuum chamber 3. The second pair of strips 62 takes care of the guidance of said front border 63 of the film web 51 over the table 7. The retaining pair 61 is mounted in a stationary manner on the cover basic body 10, whereas the guide pair 62 may be guided in front of the opening 15 of the chamber upper part 4 in a manner known per se. For this purpose, rails, for example, (not shown) may be fitted on the sides of the cover basic body 10, in which rails the end parts of the guide pair 62 can slide.

FIG. 4 indicates schematically that the second end of the material web 57 is connected to the guide pair 62. As has already been described, the advancement roller 56, on which the material web 57 is wound up, can be driven. If a new section of the film 51 is to be drawn over the table 7, then the advancement roller 56 is set in operation and it draws the material web 57 through between the chamber parts 4 and 5 until the guide pair 62 is located in front of the front side of the vacuum chamber 3 (FIG. 3). The drive of the advancement roller 56 is then switched off and it can be set to idle. This operation takes place before the vacuum chamber 3 is closed.

The rearwards movement of the guide pair 62 takes place upon opening of the machine when the machine cover 2 passes into its oblique position (FIG. 2). The guide pair 62 moves back, under the action of its own weight, into its lower position in the vicinity of the retaining pair 61, and draws the material web 57 along with it in the process. Said material web now extends between said guide pair 62 in its lower position and the advancement roller 56, with the result that the material web 57 covers over the heating plate 19. The material of this web 57 is selected to be comparatively thick and also to be as heat-resistant as possible. Due to the fact that the heating plate 19 is immediately covered over by said material web 57 when the machine is opened, the operator cannot burn himself on the hot heating plate 19.

The retaining pair 61 comprises two strips 64 and 65 which are located one above the other and of which one strip 64, the upper strip, is fixed. A lifting cylinder 66 is mounted on said strip 65 [sic], the lifting rod 67 of said lifting cylinder passing through an opening in said fixed strip 64 and being connected to the second, lower strip 65 of this pair 61. The lower strip 65 may thus be moved in the vertical direction. FIG. 4 represents the movable strip in its upper position, when the front border 63 of the film is clamped between said strips 64 and 65.

The guide pair 62 likewise comprises two strips 68 and 69 which are located one above the other and of which one strip 68, the upper strip, is fixed. A lifting cylinder 70 is mounted on said strip 68, the lifting rod 71 of said lifting cylinder passing through an opening in said fixed strip 68 and being connected to the second, lower strip 69 of this pair 62. The lower strip 69 may thus be moved in the vertical direction. FIG. 4 represents the movable strip in its upper position, when the front border 63 of the film is clamped between said strips 68 and 69.

The active surfaces of the fixed strips 64 and 68 of the pairs of strips 61 and 62 are located in the same plane. The end sides of the pairs of strips 61 and 62 run in a virtually meandering fashion (FIG. 1), with the result that each pair of strips 61 and 62 has adjacent jutting-out projections 72 and 73 and gaps 74 and 75 located therebetween. The projections 72 of one pair of strips, e.g. 61, are located in the gaps 75 or between two adjacent projections 73 of the other pair of strips, e.g. 62. The dimensions of the meandering forms of the pairs of strips 61 and 62 are such that the pairs of strips 61 and 62 are not in contact with one another when they are located one beside the other.

In FIG. 4, the arrow 54 indicates the action of the cutting device 54 which severs from the front border 63 of the supply of film that section of the film 51 which is located in the vacuum chamber 3. The cutting device 54 acts on the film 51 in front of the end surfaces of the projections 72 of the retaining pair 61. This is readily possible because the cutting device 54 only acts on the film 51 once the guide pair 62 has transported the film section through the vacuum chamber 3 and is located in the front region of the machine cover 2. The front edge of the film border 63 is thus located in the region of the end surfaces of the projections 72 of the retaining pair 61. Those sections of the edge of said film border 63 which extend between two adjacent projections 72 of said retaining pair 61 hang freely in the gaps 74 between the adjacent projections 72.

When the guide pair 62 returns to the retaining pair 61 again, then the lower strip 69 of the guide pair 62 is first of all lowered by the lifting cylinder 70. When the guide pair 62 reaches its end position, then the film border 63 is located between the projections 73 of the strips 68 and 69 of the said guide pair 62. This is because the projections 73 of the guide pair 62 engage into the gaps 74 in the retaining strip 61, where the film border 63 is located. The movable strip 69 of the guide pair 62 may then be pressed against the fixed strip 68 by the lifting cylinder 70, and the guide strip 62 likewise secures the film border 63. In order to be able to draw the now necessary film section through the chamber 3, the movable strip 65 of the retaining pair 61 has to be lowered in order that the film 51 is freed, and the advancement roller 56 has to be set in operation. The guide strip 62, together with the said section of the film 51, is drawn through the vacuum chamber 3 by way of the material web 57.

FIG. 5 represents a detail of another configuration of the vacuum packaging machine. This is a socalled bag-type machine. In the case of such machines, the items which are to be packaged are placed in a bag, and the bags are positioned in the vacuum chamber 80 of said machine such that the opening part of the bag is located on the lower strip 82 of a heatable pair of strips. Once the chamber 80 has been evacuated, the opening of the bag is closed between the heated strips 81 and 82 in the vacuum chamber 80. In this configuration of packaging machines, virtually the same problem [sic] arise as in the configuration of packaging machines which has been described above in detail. Consequently, all the abovedescribed measures may also be used in this lastmentioned configuration of packaging machines. However, it goes without saying that the measures described here may also be used on other machines.

We claim:

1. A vacuum-packaging machine comprising a substructure (1), a cover (2) that is movable in relation to said substructure, and a driving mechanism for moving said cover (2) in relation to the substructure (1), wherein the driving mechanism (20) is designed such that movement of the cover relative to the substructure has a rectilinear component and a swivelling component, wherein the driving mechanism (20) is designed such that said rectilinear and swivelling components of the cover's movement are sequential and partly overlap each other, with the result that the cover's movement in a first end-region of travel is rectilinear and movement in an opposing end-region of travel is swiveling.

2. A vacuum-packaging machine as claimed in claim 1, characterized in that: the driving mechanism (2) has at least one arm (11, 12), connected to a basic body (10) of the cover (20) of the machine; the driving mechanism (20) has at least one guide roller (21) for guiding the arm (11, 12); which guide roller (21) is mounted on the substructure (1); the arm (11, 12) is designed to engage said guide roller to effect swivelling and moving longitudinally, thereon; and the driving mechanism (20) comprises an actuating device (25), which is connected to an end-part of the arm (11, 12) that is distal to the cover.

3. A vacuum-packaging machine as claimed in claim 2, characterized in that: a guide roller (21) is mounted on each of mutually opposite side-walls (43, 44) of the substructure (1); each guide roller (21) is arranged in the vicinity of a rear wall (45) of the substructure (1); each arm (11, 12) has a U-shaped or C-shaped cross-section; and each guide roller (21) is arranged inside an arm (11, 12).

4. A vacuum-packaging machine as claimed in claim 3, characterized in that: the basic body (10) is in a plate form and is rectangular; each arm (11, 12) is mounted on one of the mutually opposite side-walls (43, 44); the arm is fastened to a corner region of the basic body (10); and the basic body (10) projects practically at right angles from the arms (11, 12).

5. A vacuum-packaging machine as claimed in claim 4, wherein an end part of each arm is mounted on one of the side walls, and said end part is fastened to the corner region.

6. A vacuum-packaging machine as claimed in claim 2, characterized in that: the actuating-device (25) has at least one single-armed swivelling lever (26); one end part (28) of the swivelling lever is pivotally connected to the substructure (1); an opposite end part (27) of the swivelling lever (26) is pivotally connected to the end-part of the arm that is distal to the cover (2); the actuating-device (25) further has at least one double-acting lifting cylinder (30); and an end part of the lifting cylinder is pivotally connected to the swivelling lever (26), whereas an opposite end part of the lifting cylinder is pivotally connected to the substructure (1).

7. A vacuum-packaging machine as claimed in claim 6, comprising two of said swivelling levers (26) spaced at a distance from each other, characterized in that: a connecting rod is disposed between the two swivelling levers (26); and one end part of the lifting cylinder is pivotally connected to the connecting rod, whereas an opposite end part of the lifting cylinder is pivotally connected to the substructure (1).

8. A vacuum-packaging machine as claimed in claim 1, further comprising a vacuum chamber (3, 80) that has an upper part (4) and a lower part (5); each of said parts (4, 5) has an opening (15); which openings face each other; the upper part (4) of the chamber is arranged in an opening on the underside of the cover; the lower part (5) of the chamber is arranged in a top side (47) of the substructure (1); and the openings (15) in the upper and lower parts (4, 5) abut each other air-tightly when the machine is closed.

9. A vacuum-packaging machine as claimed in claim 8, further comprising a heating element (19) that is provided inside a bottom (39) of the upper part (4) of the chamber; a table (7), to receive goods to be packaged, in the region of the opening in the lower part (5) of the chamber; wherein said table (7) is fastened to a lifting cylinder (8) which effects movement of the table vertically towards the heating element (39), permitting retraction, therefrom.

10. A vacuum-packaging machine as claimed in claim 8, further comprising a device (50) provided for feeding a film (51) into the area of the upper and lower chamber-parts (4, 5); and said device (50) comprises a storage section (52) serving to hold a supply of film (51), and advancement means (55) for advancing the film (51).

11. A vacuum-packaging machine as claimed in claim 10, characterized in that: the storage section (52) comprises a roller (58) mounted rotatably on the substructure (1), on which the film (51) is wound; and a deflection roller (53) for the film (51); said deflection roller (53) is arranged in a region of a rear wall of the cover (2); and this deflection roller (53) is arranged so that the film (51) can pass through between the parts (4, 5) of the chamber.

12. A vacuum-packaging machine as claimed in claim 10, characterized in that the advancement means (55) for the film (51) comprises a drivable roller (56) which holds a web of material (57), holding-means (61) and guidance-means (62) for the film; the holding-means (61) is mounted stationarily on the basic body (10) of the cover; and the guidance-means (62) is mounted so as to be able to move along the opening (15) provided in the upper part (4) of the vacuum chamber.

13. A vacuum-packaging machine as claimed in claim 12, characterized in that: the advancement roller (56) is arranged in front of and parallel to front wall (34) of the upper part (4) of the vacuum chamber (3); the holding means (61) is arranged in front of a rear wall of the upper part (4) of the vacuum chamber, and is designed to hold a front edge (63) of the supply of film (51); the guidance means (62) is attached to the basic body (10) in such a way as to be able to move between the retaining means (61) and the advancement roller (56); an end part of the web of material (57), projecting from the advancement roller (56), is attached to the guidance-means (62); and between the holding-means (61) and the vacuum chamber (3) a device (54) is arranged which is able to cut a requisite length of film (51) for enclosing and sealing an object when present in the vacuum chamber (3).

14. A vacuum-packaging machine as claimed in claim 12, characterized in that: the retaining means (61) and the guidance-means (62) comprise pairs of strips (64, 65; 68, 69); said pairs of strips comprising respectively of a fixed strip (64, 68) and a movable strip (65; 69) that is movable perpendicularly to the fixed strip; the holding means and guidance means (61; 62) are each provided with a lifting cylinder (66; 67) mounted on the respective fixed strip (64; 68); the lifting rod (67; 71) of the respective lifting cylinder (66; 67) is connected to the movable strip (65; 69); the end part of the web of material (57) projecting from a take-up roller (56) is connected to the fixed strip (68) of the guidance-means (62), and said web of material (57) is at least as wide as the heating element (19) in the vacuum chamber (3); and working surfaces of the fixed strips (64; 68) which act on the film (51), are practically in the same plane.

15. A vacuum-packaging machine as claimed in claim 14, characterized in that the working surfaces of the fixed strips (64;68), and working surfaces of the movable strips (65;69) have projections (72) with gaps (73) between them; the fixed and movable strips (64, 65; 68, 69) are arranged with respect to one another such that each projection (72) on one of the fixed strips (64; 68) is disposable in a space in a respective gap (73) in one of the movable strips (65; 69); and the machine further comprises a cutting device (54) positioned in front of the projections (72) of the holding means (61).

16. A vacuum-packaging machine as claimed in claim 8, further comprising heatable sealing strips (81, 82) that are arranged in the vacuum chamber (80) to receive between them, an opening part of a bag containing the product to be packed, when placed in the machine.

17. A vacuum-packaging machine as claimed in claim 2, characterized in that: the cover (2) of the machine has a hood (13) which covers the basic body (10) of the cover; a top side of the basic body (10) of the cover is provided with bearing means (16) which bear the hood (13) in a sprung manner such that the hood (13) moves perpendicularly to the plane of the basic body (10); and wherein the machine further comprises signaling means (49) which are able to signal the position of the hood (13) relative to the basic body (10) of the cover.

18. A vacuum-packaging machine as claimed in claim 17, characterized in that: the hood (13) has a bottom (37), and side walls are suspended from said bottom (37); lower edges (14) of side walls (36) of the hood are lower than lower edges (15) of side-walls (34) of the upper part (4) of the vacuum chamber; the bearing means (16) comprise bushings (17) which are arranged at least in each corner of the basic body (10) and, thus, also of the hood (13), and are fastened in an upper region of the basic body (10) of the cover; in each bushing (17), a spring (18) is arranged, on which a section of the hood (13) located above it is seated; the signaling means comprise at least one switch (49), which is arranged between the hood (13) and the basic body (10) of the cover and which is connected to control circuits; and downward movement of the cover (2) is stopped when the lower edge (14) of the at least one of the side walls (36) meets an obstacle.

* * * * *